United States Patent [19]

Lin

[11] 4,111,620

[45] Sep. 5, 1978

[54] HEATED SPRAY SPINNING NOZZLE AND ATTENUATION SYSTEM

[75] Inventor: Victor J. Lin, Berkeley Heights, N.J.

[73] Assignee: Celanese Corporation, New York, N.Y.

[21] Appl. No.: 802,384

[22] Filed: Jun. 1, 1977

[51] Int. Cl.[2] ..... D01D 5/12

[52] U.S. Cl. ..... 425/66; 425/72 S

[58] Field of Search ..... 425/66, 72 S; 264/176 F; 65/16

[56] References Cited

U.S. PATENT DOCUMENTS

| | | | |
|---|---|---|---|
| 3,543,332 | 12/1970 | Wagner et al. | 425/72 S |
| 3,849,040 | 11/1974 | McGinnis et al. | 425/72 S |

*Primary Examiner*—Robert D. Baldwin

*Attorney, Agent, or Firm*—Kenneth A. Genoni

[57] ABSTRACT

A spray spinning nozzle for producing a substantially continuous filament from a molten synthetic resinous material includes a nozzle with an orifice from which a filament of molten material is emitted and a gas attenuation assembly which slides axially over the nozzle. The attenuation assembly includes at least three gas jets spaced about and radially close to the nozzle axis for emitting high velocity jets which converge upon and contact the filament at a point along the nozzle axis in front of an orifice. Drag forces produced by the gas stream attenuate the filament to a thin diameter. The nozzle includes a plurality of circumferentially spaced recesses which cooperate with corresponding recesses and projections of the attenuation gas assembly to accommodate heater means and to provide mounting means.

8 Claims, 5 Drawing Figures

Fig. 1
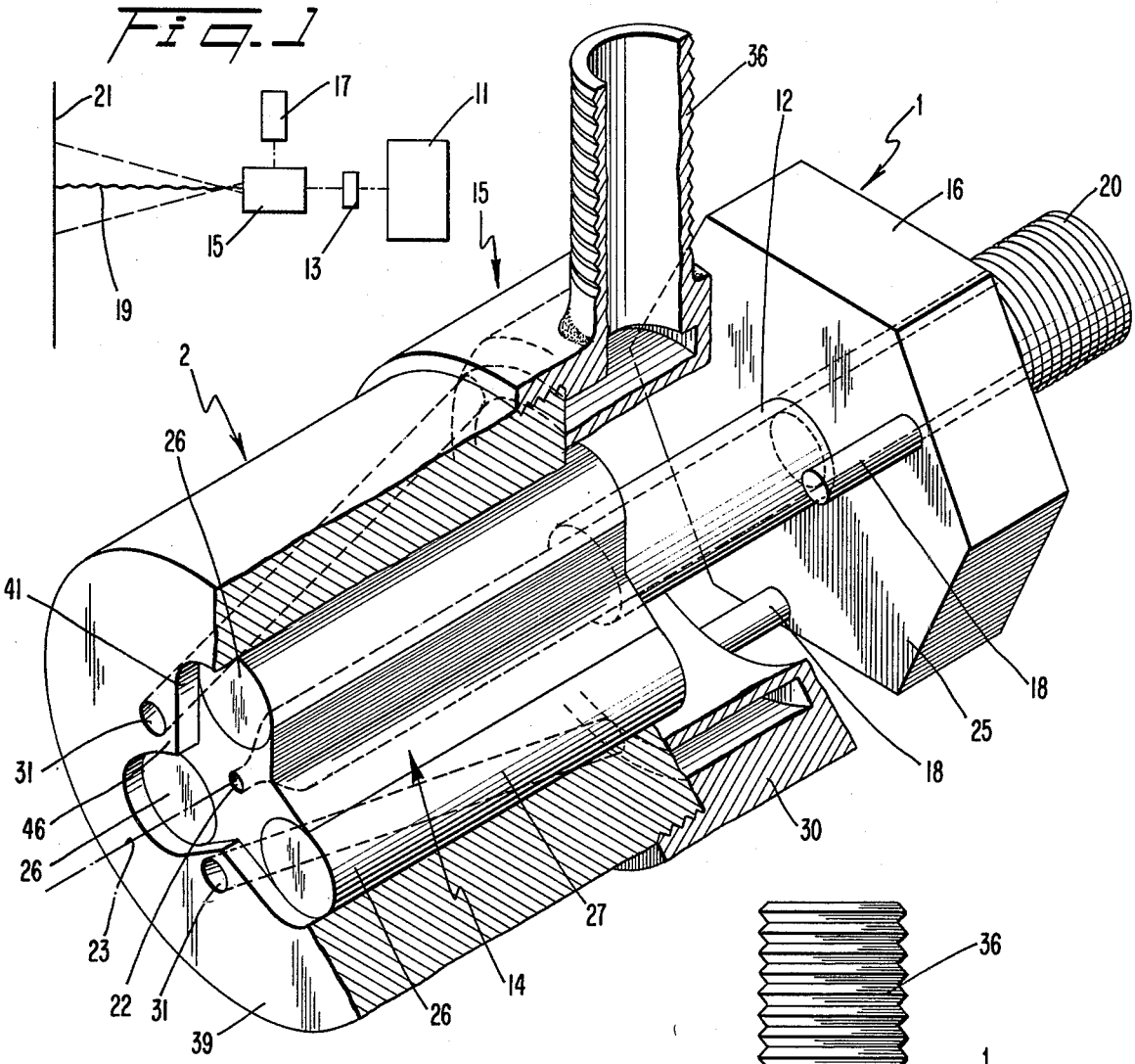
Fig. 2
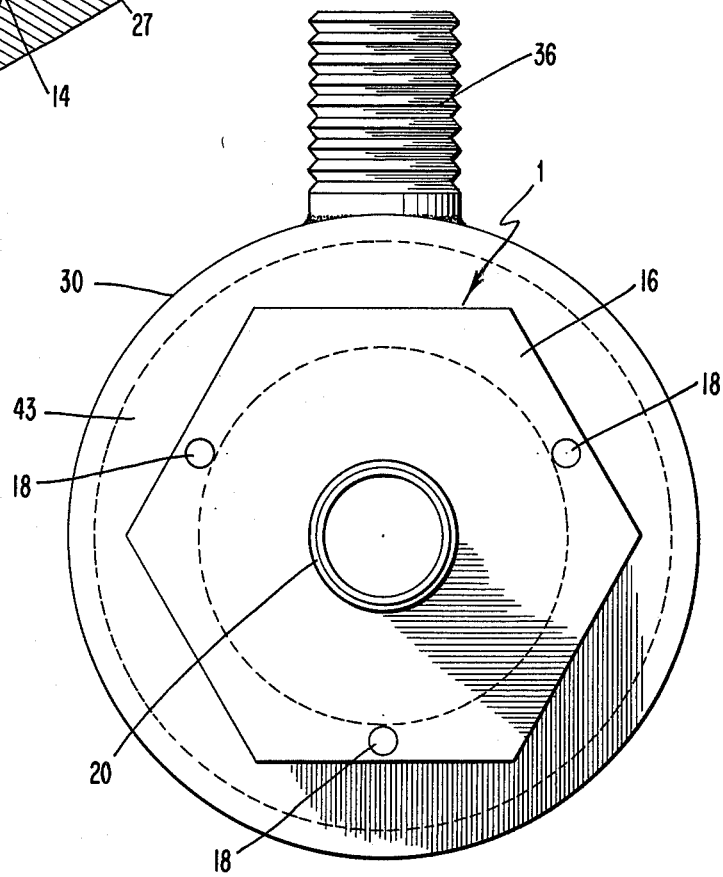
Fig. 3

HEATED SPRAY SPINNING NOZZLE AND ATTENUATION SYSTEM

BACKGROUND OF THE INVENTION

This invention relates generally to the production of filamentary material and more particularly to a novel spray spinning nozzle for spinning molten polymers to form a nonwoven structure.

Various apparatus has been developed in the past to create an integrated system for forming a fibrous assembly, such as a nonwoven fabric or the like, directly from a molten filament forming material. Typically, such an apparatus may use an extruder in which one of various kinds of synthetic resinous polymeric material is melted under the influence of heat and pressure to form a quantity of molten material which can then be forced through a nozzle orifice as a continuous liquid filament. Each of a plurality of high velocity gaseous jets is directed along the freshly extruded filament at a shallow angle to create a drag force for attenuating the filament which is then carried along by the attenuating aqueous jets and deposited on a collection surface to form a nonwoven structure. Such a device in the past has been known as a spray spinning apparatus because the filamentary material appears to be sprayed against the collection surface.

The attenuating gaseous jets contribute to filament cooling as well as attenuating and conveying the filament to the collection surface. Since the filament of polymeric material is still in a somewhat molten or tacky stage as it strikes the collection surface, some sticking together occurs at each point where the filament contacts itself. Also, the filament may loop about and stick to itself.

One such spray spinning apparatus is shown in U.S. Pat. No. 3,849,040 which is assigned to the assignee of the present patent application. This patent shows a stream of filamentary material emanating from a nozzle. A pair of elongated attenuating gas jets, each with a rectangular cross section, are placed on either side of the nozzle. The gas jet outlets are both in the same plane perpendicular to the nozzle axis, positioned forward of the nozzle orifice and the jets intersect at a point offset from the nozzle axis in the plane of the nozzle axis. The axial component of the drag forces produced on the filament by the gas jets attenuates the filament. Great care must be taken to control the geometry of the gas jets to provide a proper distribution in the collected filament.

One disadvantage of this system is that the angles of the gas jets require adjustment when the gas pressure or polymer flow rate is changed. Thus, careful and time-consuming control of the gas pressure and gas jet angles is required.

The molten polymer and the attenuating gas do not flow through the same nozzle. The gas jets are separated from the nozzle orifice by an insulating means such as an air space. As a result, the gas jets produce a low pressure area near the nozzle orifice which induces a flow of ambient air past the nozzle. This induced flow tends to convectively cool the nozzle and to cause the molten material to harden and obstruct the orifice: known as nozzle freeze-up.

Another disadvantage of such apparatus relates to the difficulty in controlling the spray pattern. The filament seems to wander causing an unduly broad and unfocused spray pattern. Accordingly, positioning of spray spinning nozzles for product uniformity is difficult.

In the past it has been necessary to use high throughput rates of polymeric material through the nozzle to reduce nozzle freeze-up. This produces a thicker filament, requires higher gas supply pressures to obtain higher momentum attenuating gas jets and requires the distance between the nozzle orifice and the collection surface to be greater than desired. As a result of these higher operating parameters, the nonwoven fabric produced by present spray spinning apparatus has not been entirely satisfactory. The filament is relatively thick and also includes quantities of "shot" which is solid debris or beads of non-attenuated polymer which increase cost and weight of a product and undesirably affect the feel of the nonwoven fabric. Uniformity of fiber thickness and spray pattern has been difficult to attain and maintain. Collection can be difficult and attenuation efficiency has been low. Under these conditions overall operation can be difficult.

There is a need for a nozzle attenuating system which can be continuously operated without freezing due either to conductive cooling caused by direct contact between the gas jet and the nozzle body or convective cooling caused by induced air flow when the gas jet is spaced apart from the nozzle body. A nozzle which does not readily freeze-up will permit lower polymer throughput rates and improve the resulting filament and nonwoven product. It is also desirable to have a gas jet which can be easily disassembled from the nozzle body to reduce the time necessary to clean the nozzle should it become obstructed.

SUMMARY OF THE INVENTION

The present invention provides a nozzle-attenuation system which will direct a continuous flow of attenuating gas into contact with a filament of freshly extruded polymeric material while causing a minimum risk of nozzle freeze-up.

The nozzle of the present invention includes a narrow central portion connecting an enlarged tip portion and a mounting head for connecting the nozzle to an extruder. The enlarged tip portion includes recesses spaced about the peripheral surface thereof for partially accommodating conductive heating means. It has been discovered that the fluid properties of the polymer melt will not be adversely affected by providing conduction heating in the area of the nozzle tip portion. Consequently, the present invention provides heating means to maintain the nozzle tip portion within a predetermined temperature range, to reduce the possibility of nozzle freeze-up. The enlarged tip portion is constructed of metal with a good thermal conductivity and has a sufficient mass of material to facilitate an even temperature distribution throughout the tip.

Spaced between the heater means recesses on the nozzle tip are a plurality of notches that facilitate the placing of gas jets exits of the attenuating system radially close to the nozzle orifice. The notches also provide a means for mounting the attenuating system on the nozzle. It is desirable to place the gas jets radially close to the nozzle centerline so that the angle at which the gas jet contacts the freshly extruded filament may be made small. This permits, among other things, the use of lower gas stream supply pressures. Also, because the present invention contemplates lower polymer nozzle throughput rates, it is desirable to have the gas stream contact the filament quickly at a position close to the nozzle orifice.

The gaseous jet attenuating assembly includes an annular manifold and a generally cylindrical gas jet housing which slides onto the nozzle. The manifold has an annular plenum chamber which communicates with a plurality of gas jet passages in the gas jet housing. The discharge openings of the gas jet passages are disposed in a small circle about the nozzle axis. The gas jet passages may be aligned so that the individual attenuating gas jets converge at a small angle to the nozzle axis and intersect one another at a common point along the nozzle axis in front of the nozzle orifice.

The gas jet housing includes a central passage which has projections directed toward the nozzle axis. The projections mate with the complimentary notches on the nozzle tip portion. The gas jet discharge openings are in these projections to facilitate jet placement radially close to the nozzle axis. Clearance between the projections and the notches is sufficient to permit sliding of the manifold assembly onto the nozzle. There is not a sufficient space to permit an induced air flow to develop about the nozzle tip portion.

The gas jet housing also includes recesses between the projections which are complimentary to and align with the corresponding recesses on the nozzle tip portion so as to form pockets in which the heater means may fit. As the attenuating assembly slides over the nozzle, the rear surface of the gas manifold abuts spikes which project axially forward from the forward facing surface of the nozzle mounting head to provide a working space for the heater electrical connection.

When assembled, the nozzle orifice is preferably recessed behind the free end of the gas jet housing. The plane of the gas jet discharge openings is slightly forward of the exit plane of the nozzle orifice so as to reduce the risk of nozzle freeze-up from gaseous jet cooling.

BRIEF DESCRIPTION OF THE DRAWINGS

Other features and advantages of this invention will be apparent from the following description of the preferred embodiments thereof taken in conjunction with the following drawings wherein:

FIG. 1 is a schematic illustration of an integrated spray spinning system;

FIG. 2 is a perspective view of the spray spinning nozzle in accordance with the present invention with portions broken away;

FIG. 5 is a rear elevational view of the nozzle.

DESCRIPTION OF THE PREFERRED EMBODIMENT

Figure 3:
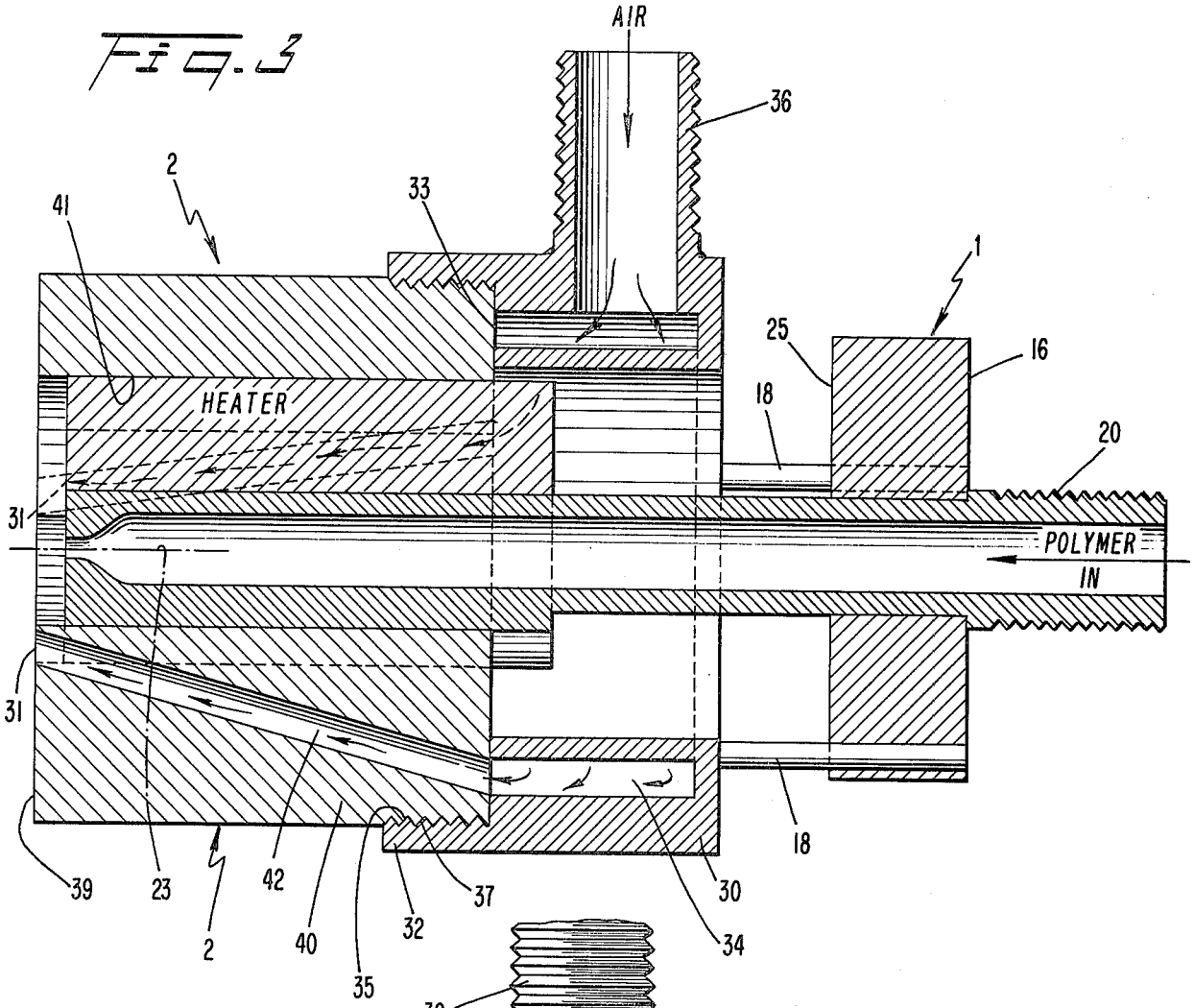
FIG. 3 is a partial cross-sectional view taken longitudinally of the nozzle of FIG. 2.

Referring now to FIG. 1 there is shown a schematic illustration of an integrated spray spinning system in which the present invention may be employed. The system includes a polymer source such as a suitable conventional extruder 11 in which one of various kinds of synthetic resinous polymeric material may be melted under the influence of heat and pressure, a melt pump 13 for further pressuring the melted material and controlling the throughput rate into a combined nozzle and gas attenuation assembly 15. Attenuation gas is provided to assembly 15 by a source of pressurized gas 17 which may be ambient air. A substantially continuous filament 19 of molten material is emitted from assembly 15 and attenuated by gas jets emanating from assembly 15, and is deposited on a collection surface 21.

The combined nozzle and gas attenuation assembly 15 (see FIG. 2) is generally horizontal and includes an extrusion nozzle assembly (generally identified as 1) from which the filament of molten polymeric material is emitted. The gas from the attenuation assembly (generally designated as 2) attenuates, conveys and deposits the filament onto the collection surface to form a three-dimensional nonwoven structure.

The nozzle assembly has a generally cylindrical central portion 12 connecting an enlarged tip portion 14 and a mounting device in fluid communicating relationship. The tip portion 14 has a generally star-shaped cross section. The mounting device including a hexagonal mounting head 16 for attachment to a source of polymeric material. Three axially aligned spacer spikes 18 are supported at a fixed radial distance from a nozzle axis 23 or centerline and are substantially equiangularly distributed on a forward facing surface 25 of the head 16. The spikes 18 are operable to axially position the filament attenuating assembly 2 relative to the nozzle 1. A threaded connection 20 may extend from a rearward facing surface of the head 16 for connecting nozzle 1 to the polymer source.

Figure 4:
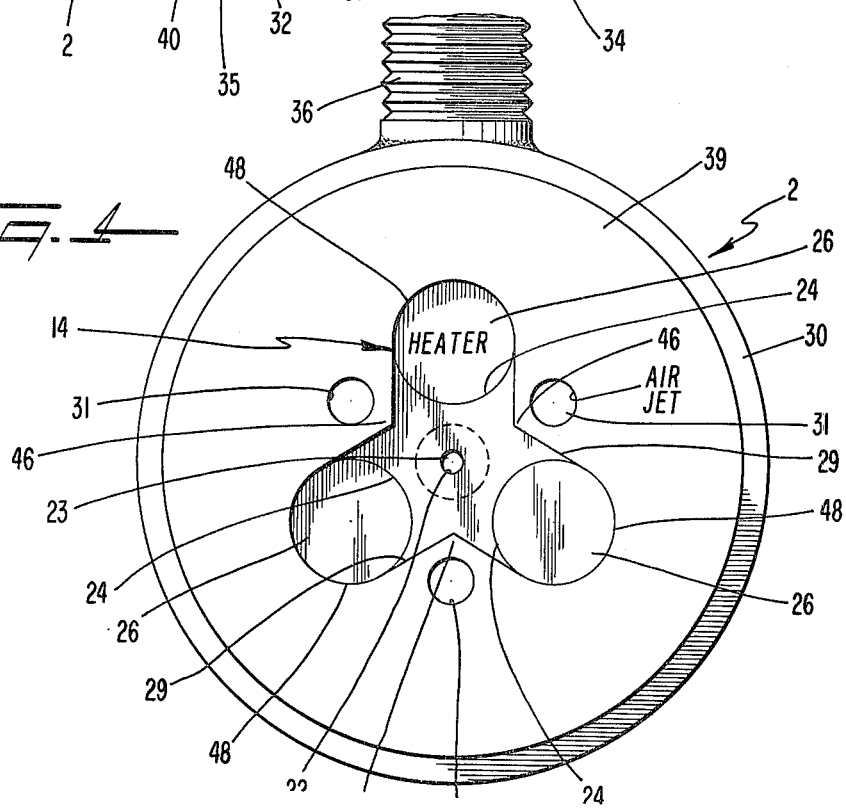
FIG. 4 is a front elevational view of the nozzle.

The nozzle tip portion 14 terminates in a small extrusion orifice 22 which ultimately sizes the filament. The orifice 22 may have a diameter of about 0.016 inch and a length of about 0.064 inch. The tip portion 14 has a peripheral surface 27 that includes three axially aligned concave arcuate recesses 24 (see FIG. 4). The recesses 24 are substantially equiangularly spaced around the periphery of enlarged tip 14. Heating elements 26, such as generally cylindrical cartridge heater rods, are partially surrounded by the recesses 24 to provide conductive heat transfer to the tip portion 14. The heater elements 26 maintain tip portion 14 within a pre-determined temperature range by conductive heat transfer to minimize the possibility of nozzle freeze-up. The predetermined temperature range is preferably between the melting temperature of the particular polymeric material and that temperature at which the polymeric material becomes so degraded as to be incapable of forming a substantially continuous filament.

Between the plurality of recesses 24 is a plurality of axially aligned spaced "V" shaped concave notches 29 that facilitate placement of gas jet discharge openings 31 of the attenuating assembly 2 radially close to the nozzle axis 23. If desired, cancave notches 29 may be equiangularly spaced. In addition, the notches 29 provide a rotation limiting mounting on the nozzle 1 for attenuating assembly 2.

While the recesses 24 may be portions of a cylindrical surface, they are selected to conform to the external configuration of the corresponding heating element 26 and need not be arcuate. In addition, the notches 29 need not be "V" shaped as any convenient shape will be satisfactory. The recesses 24 and the notches 29 also need not be axially aligned parallel to the nozzle axis: the notches or the recesses or both may taper at convenient angles to permit even closer radial placement of gas jet exits to the nozzle orifice 22.

The nozzle 1 and especially the enlarged tip portion 14 are preferably made of a metal which has good thermal conductivity. The tip portion 14 is radially enlarged to provide a sufficient mass of material to facilitate even temperature distribution throughout tip 14.

The filament attenuating assembly 2 functions to direct jets of attenuating gas along the filament of freshly extruded molded polymer after the filament leaves the nozzle orifice 22. These jets of attenuating gas (preferably ambient air) produce a drag force on the filament to attenuate it into a relatively fine diameter preferably in the range of 0.0002 inch to 0.005 inch. The drag force exerted on the extruded filament occasionally may cause the filament to break but the filament produced is substantially continuous in the sense that its length is on the order of feet. The attenuated filament is carried by the jets and deposited on a collection surface. Filament diameter will depend upon extrusion throughput rate, nozzle orifice dimensions and the operating gas pressure and the gas flow rate of the attenuation assembly.

The attenuating assembly 2 includes an annular manifold 30 and a generally cylindrical gaseous jet housing 40 (see FIG. 3) which are held together in coaxially aligned abutting relationship by external threads 35 disposed on the outside of the housing 40 and mating internal threads 37 on the inside of a coaxial flange 32 which extends forwardly from an abutting surface 33 of manifold 30. The outside diameter of the annular manifold 30 is greater, and the inside diameter of the annular manifold 30 is less than the outside diameter of the housing 40 so that the manifold 30 abuts and overlaps the end of housing 40. The manifold 30 includes a coaxially aligned annular slot extending from the abutting surface 33 partway through the manifold 30 to form an annular coaxial plenum chamber 34. The chamber 34 receives attenuating gas delivered thereto through an intake connection 36 from the source of pressurized gas.

Three straight angularly spaced gas passages 42 extend through the length of the air jet housing 40. Each gas passage tapers at the same angle relative to the nozzle axis 23. One end of each passage 42 communicates with chamber 34; the other end of each passage 42 communicates with chamber 34; the other end of the passage exhausts through a corresponding discharge opening 31 in the free end surface 39 of the housing 40 remote from manifold 30 and perpendicular to the nozzle axis 23. Each passage 42 provides a jet of attenuating gas emanating from air jet housing 40 and converging on the nozzle axis at a common point downstream of the extrusion orifice. The discharge openings 31 of the passages 42 may be equiangularly spaced at a common radius from the nozzle axis 23. Each passage 42 tapers at an angle less than 45° to the axis and preferably in the range of 10° to 30°. A minimum of three passages 42 are required to provide spatial equilibrium of the fluid acting on the filament. Any number greater than three passages 42 may be used. Preferably, the passage exits are equiangularly spaced at a fixed radial distance from the centerline of housing 40 to provide a balanced fluid flow.

The inner peripheral surface or wall 41 (see FIG. 2) of the air jet housing 40 defines an axially aligned central passage which permits the housing 40 to slide onto the nozzle tip 14. The inner peripheral surface 41 conforms to the surface 27 of the nozzle tip 14 (see FIG. 4) and includes a plurality of complimentary recesses 48. The complimentary recesses 48 and the recesses 24 of the nozzle tip 14 are in radial alignment with one another and define pockets for the heating elements 26. Accordingly, the complimentary recesses 48 may be cylindrical in configuration where the heating element is cylindrical. While the recesses 48 may be axially aligned, they may also be inclined relative to the nozzle axis.

The confronting complimentary recesses 48 and recesses 24 which form the pockets for heater elements 26 are spaced to provide metal contact completely surrounding elements 26 to minimize thermal gradients in the surface of the heater elements 26 which may cause damage to said heater elements.

In addition, the internal surface 41 defines spaced projections 46 which conform to and mate with complimentary "V" shaped notches 29 on nozzle tip 14. The clearance between the projections 46 and the notches 29 is sufficient to permit housing 40 to be easily inserted over and removed from the nozzle tip in the axial direction and to permit sufficient thermal expansion of the tip 14 under the influence of heating rods 26 to prevent binding. The projections 46, like the notches 29, need not be axially aligned but may taper to permit even closer placement of air jet discharge openings 31 to the nozzle orifice 22.

When the spray spinning nozzle is assembled, the attenuating assembly 2 fits coaxially over nozzle assembly 1 so that the extrusion orifice 22 is recessed behind the end surface 39 of air jet housing 40. The proper recessed distance is maintained by the spikes 18 which project from the forward facing surface of the hexagonal mounting head 16 and abut against the confronting face of the manifold 30 (see FIG. 5). Preferably, the spikes 18 space the head 16 apart from the manifold 30 a sufficient distance to permit a working space for heater and instrument wiring.

In operation, a molten polymeric material enters the nozzle 1 through threaded connector 20 and exits through the extrusion orifice 22 as a filament. Attenuating gas enters the intake 36, circulates in the chamber 34, and passes out through the gas passages 42 in three jets. The jets exhaust from the housing 40 downstream of the orifice 22 and intersect each other at a point on the nozzle axis 23.

Drag forces produced by the jets attenuate the freshly extruded filament to a fine diameter. The stream of fluid, including the jets and entrained ambient air carry the filament along and deposit it on a collection surface to form a nonwoven structure.

An electric current is passed through the heater rods 26 by a suitable conventional electric circuit (not shown). As the rods 26 have a high electrical resistance, heat is generated and evenly distributed throughout the thermal mass of the enlarged nozzle tip 14 by heat conduction. The nozzle tip 14 is maintained at a relatively uniform temperature which generally corresponds to the melt temperature of the polymer being spun to minimize nozzle freeze-up. The heaters 26 may also have the effect of heating the gas manifold 40 and thus heating the gas jets as they pass through the passages 42.

The present invention provides a nozzle attenuation system that produces a substantially continuous polymer filament that can be collected into a satisfactory nonwoven structure.

It has been found that satisfactory nonwoven structures may be produced from various polymeric materials, for example, polypropylene, nylon, PET or polyacetal. It has been found that satisfactory conditions of producing polypropylene non-woven structures include a melt temperature of 600° F. to 750° F. which produces a liquid melt having appropriate viscosity. A melt throughput of 1 to 10 lbs. per hour with a recessed nozzle is appropriate for an orifice diameter of 0.016 inch and an orifice length of 0.064 inch used in conjunction with the gas manifold. The gas manifold may have three gas passages which provide jets of air each directed at an angle of 15° to the nozzle axis and intersecting each other on the axis in front of the nozzle orifice. With ambient air supplied to the manifold at a pressure in the range of 10–100 p.s.i.g. satisfactory filament is produced.

Average filament diameters obtainable with the nozzle attenuation system of the present invention are in the range of 0.0002 inch to 0.005 inch for polypropylene, nylon and PET. Large fiber diameter is obtained from polyacetal.

Tests were conducted using nylon to compare the non-woven structure obtained from the spray spinning apparatus disclosed in U.S. Pat. No. 3,849,040 with the nonwoven structure obtained using the apparatus in the present invention. The results are shown in the following table:

| Test Parameter | U.S. Pat. 3,849,040 | | Present Invention | |
|---|---|---|---|---|
| Throughput in lbs. per hour | 4.0 | 4.5 | 6.4 | 6.4 |
| Air pressure (p.s.i.g.) | 55 | 100 | 40 | 80 |
| Web tensile strength (lbs. per 3" of width) | 6.0 | 4.6 | 6.0 | 12.9 |
| Fiber size, average (mils) | 3.3 | 3.6 | 1.9 | 0.73 |

It can be seen from the foregoing table that the tensile strength of the nonwoven structure produced by the apparatus of the present invention is as strong as or stronger than that produced by the patented invention. Because the nozzle attenuating system of the present invention is well protected against nozzle freeze-up, it is possible to operate with a smaller polymer throughput rate and thus produce a finer filament of more uniform thickness and stronger tensile strength. Also, because the present apparatus is able to use smaller throughput rates and provide a thinner filament, the attenuation efficiency is higher and the pressure of the attenuating gas is correspondingly lower so that a smaller amount of air is used. This has a further benefit of permitting the collection surface to be placed close to the nozzle orifice. Moreover, there is no need to adjust the angle of the attenuating gas stream to accommodate different air pressures.

It will be understood that the particular apparatus described in this preferred embodiment in this invention is susceptible to considerable modification without departing from the inventive concept herein disclosed. Consequently, it is not intended that this invention shall be limited to the precise details disclosed but only as set forth in the following claims.

What is claimed is:

1. A spray spinning nozzle for producing a substantially continuous filament from molten synthetic resinous material comprising:

nozzle means for advancing the material to be shaped into a filament, having an axis, a first end, a second end and a peripheral surface and including an extrusion orifice for shaping the filament, positioned at the first end coaxially with respect to the axis, mounting means at the second end for connecting the nozzle means in fluid communication with a source of the material, and a plurality of circumferentially spaced recesses in the peripheral surface, each being generally parallel to the axis;

attenuating means for supplying at least three gaseous jets spaced about the axis, each jet being oriented to converge on the axis at the same point, the attenuating means being coaxial with the axis and including an annular manifold defining a plenum, and a jet housing extending forwardly from the manifold and including an inner peripheral wall conforming to the peripheral surface and having a plurality of complimentary longitudinal recesses correspondingly positioned with the plurality of circumferentially spaced recesses and cooperating therewith to define a plurality of pockets, and a plurality of spaced jet passages communicating with the plenum and aligned to converge on the axis downstream of the extrusion orifice; and heating means positioned in the plurality of pockets for supplying heat to the nozzle means.

2. The spray spinning nozzle of claim 1, wherein the peripheral surface includes a plurality of notches, each notch positioned between two of the plurality of recesses, and each of the plurality of jet passages having a discharge opening in a corresponding notch so as to reduce the diameter of a circle connecting the jet passage discharge openings.

3. The spray spinning nozzle of claim 1, wherein the said plurality of recesses and said plurality of complimentary longitudinal recesses define a plurality of cylindrical pockets.

4. The spray spinning nozzle of claim 1 wherein said notches define a generally "V" shaped surface cooperating with said conforming inner peripheral wall to rotationally position said attenuating means.

5. The spray spinning nozzle of claim 1, further including means for spacing said manifold axially apart from said mounting means to provide a working space therebetween.

6. The spray spinning nozzle of claim 1, wherein said heating means includes generally cylindrical heater rods aligned parallel to the axis of said nozzle means to provide conductive heat transfer to said nozzle means and said jet housing; and wherein said nozzle means is fashioned from a sufficient quantity of thermally conductive material to provide a temperature distribution which retards nozzle freeze-up.

7. The spray spinning nozzle of claim 1, wherein each jet passage has a discharge opening and wherein said nozzle orifice is recessed from a plane defined by the jet passage discharge opening by a predetermined distance to provide a heated recess in the vicinity of the nozzle means.

8. In spray spinning apparatus having a source of molten synthetic resinous material, a source of pressurized gaseous fluid and means for collecting a substantially continuous filament conveyed thereto by a fluid current from a nozzle, the improvement comprising:

nozzle means for advancing the material to be shaped into a filament, having an axis, a first end, a second end and a peripheral surface and including an extrusion orifice for shaping the filament, positioned at the first end coaxially with respect to the axis.

mounting means at the second end for connecting the nozzle means in fluid communication with the source of the material, and a plurality of circumferentially spaced recesses in the peripheral surface, each being generally parallel to the axis;

attenuating means for supplying at least three gaseous jets equiangularly spaced about the axis, each jet being oriented to converge on the axis at the same point, the attenuating means being coaxial with the axis and including an annular manifold defining a plenum, and a jet housing extending forwardly from the manifold and terminating in a plane perpendicular to the axis, disposed downstream of the orifice, and including an inner peripheral wall conforming to the peripheral surface and having a plurality of complimentary longitudinal recesses correspondingly positioned with the plurality of circumferentially spaced recesses and cooperating therewith to define a plurality of pockets, and a plurality of equiangularly spaced jet passages terminating in the plane, communicating with the plenum and aligned to coverage on the axis downstream of the extrusion orifice; and heating means for supplying heat to the nozzle means positioned in the plurality of pockets.

* * * * *